US011771951B2

(12) United States Patent
Targosz

(10) Patent No.: US 11,771,951 B2
(45) Date of Patent: Oct. 3, 2023

(54) EXERCISE DEVICE

(71) Applicant: Pea Eye Holdings LLC, Farmington Hills, MI (US)

(72) Inventor: Adam D. Targosz, Farmington Hills, MI (US)

(73) Assignee: Pea Eye Holdings LLC, Farmington Hills, MI (US)

( * ) Notice: Subject to any disclaimer, the term of this patent is extended or adjusted under 35 U.S.C. 154(b) by 0 days.

(21) Appl. No.: 17/155,860

(22) Filed: Jan. 22, 2021

(65) Prior Publication Data

US 2021/0245000 A1 Aug. 12, 2021

Related U.S. Application Data

(60) Provisional application No. 62/995,711, filed on Feb. 11, 2020.

(51) Int. Cl.
*A63B 22/16* (2006.01)
*A63B 21/00* (2006.01)

(52) U.S. Cl.
CPC ..... *A63B 22/16* (2013.01); *A63B 21/4034* (2015.10); *A63B 21/4035* (2015.10); *A63B 21/4047* (2015.10)

(58) Field of Classification Search
CPC . A63B 22/16; A63B 21/4034; A63B 21/4035; A63B 21/4047–4049; A63B 26/003; A63B 21/00058; A63B 21/00061; A63B 21/00065; A63B 4/00; A63B 6/00–02; A63B 21/4033; A63B 22/14–18; A63G 11/00
See application file for complete search history.

(56) References Cited

U.S. PATENT DOCUMENTS 1,437,888 A * 12/1922 Davis ..... A63G 11/00 472/113
2,581,302 A * 1/1952 Schmechel ..... A63G 11/00 472/4
3,416,792 A * 12/1968 Morgan ..... A63B 22/16 482/146
3,659,844 A * 5/1972 Cummins ..... A63B 21/023 482/106
4,270,749 A * 6/1981 Hebern ..... A63B 23/085 482/80
4,822,039 A * 4/1989 Gonzales ..... A63B 21/04 482/130
5,582,567 A * 12/1996 Chang ..... A63B 22/16 482/146
5,807,210 A * 9/1998 Devlin ..... A63B 22/0056 482/52
6,705,977 B1 * 3/2004 Ziak ..... A63B 22/18 482/79
7,645,221 B1 1/2010 Curry
9,486,670 B2 11/2016 Maximillian et al.
(Continued)

*Primary Examiner* — Joshua Lee
*Assistant Examiner* — Catrina A Letterman
(74) *Attorney, Agent, or Firm* — DARROW MUSTAFA PC

(57) ABSTRACT

An exercise device includes a platform having a surface for supporting a user of the exercise device and a base having a pivot point that defines an axis. In addition, the exercise device includes at least one arm extending from the platform to the pivot point of the base to allow the platform to rotate about the axis defined by the pivot point.

18 Claims, 7 Drawing Sheets

(56) References Cited

U.S. PATENT DOCUMENTS

| | | | | |
|---|---|---|---|---|
| 10,507,359 | B1 | 12/2019 | Shubin Stein | |
| 10,946,247 | B1 * | 3/2021 | Burton | A63B 71/0054 |
| 2003/0109365 | A1 * | 6/2003 | Smith | A63B 26/003 482/121 |
| 2005/0101441 | A1 * | 5/2005 | Rosborough | A63B 22/16 482/79 |
| 2009/0215597 | A1 | 8/2009 | Fernandez | |
| 2018/0193693 | A1 * | 7/2018 | Youm | G01P 13/00 |
| 2019/0201741 | A1 * | 7/2019 | Chang | B06B 1/167 |

* cited by examiner

EXERCISE DEVICE

CROSS-REFERENCE TO RELATED APPLICATION

This application claims the benefit of U.S. Provisional Patent Application No. 62/995,711, entitled "Quickness Equipment," filed Feb. 11, 2020, which is incorporated by reference herein in its entirety.

TECHNICAL FIELD

The subject matter described herein relates, in general, to an exercise device.

BACKGROUND

The background description provided is to present the context of the disclosure generally. Work of the inventor, to the extent it may be described in this background section, and aspects of the description that may not otherwise qualify as prior art at the time of filing, are neither expressly nor impliedly admitted as prior art against the present technology.

Exercise devices may come in several different forms. For example, some exercise devices focus more on cardiovascular health, while other exercise devices focus more on strength training. Some examples of exercise devices that focus on cardiovascular health include stationary bikes, treadmills, elliptical trainers, stepper machines, rowing machines, and the like. Exercise devices that focus more on strength training can include free weights, weight machines, and the like.

However, many exercise devices focus on one particular area—either cardiovascular health or strength training. Few exercise devices focus on trying to maximize both cardiovascular health and strength training.

SUMMARY

This section generally summarizes the disclosure and is not a comprehensive explanation of its full scope or all its features.

In one example, the exercise device includes a platform having a surface for supporting a user of the exercise device and a base having a pivot point that defines an axis. In addition, the exercise device includes at least one arm extending from the platform to the pivot point of the base to allow the platform to rotate about the axis defined by the pivot point. The axis of rotation of the platform about the pivot point is approximately between −20 degrees and +20 degrees. In another example, the exercise device may further include a handlebar extending from the base towards the platform. The handlebar may include two members extending upwards from the base and a crossbar extending between the two members to allow a user that is using the exercise device to grip the handlebar to provide additional support.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements, or multiple elements may be designed as one element. In some embodiments, an element shown as an internal component of another element may be implemented as an external component and vice versa. Furthermore, elements may not be drawn to scale.

DETAILED DESCRIPTION

Figure 1:
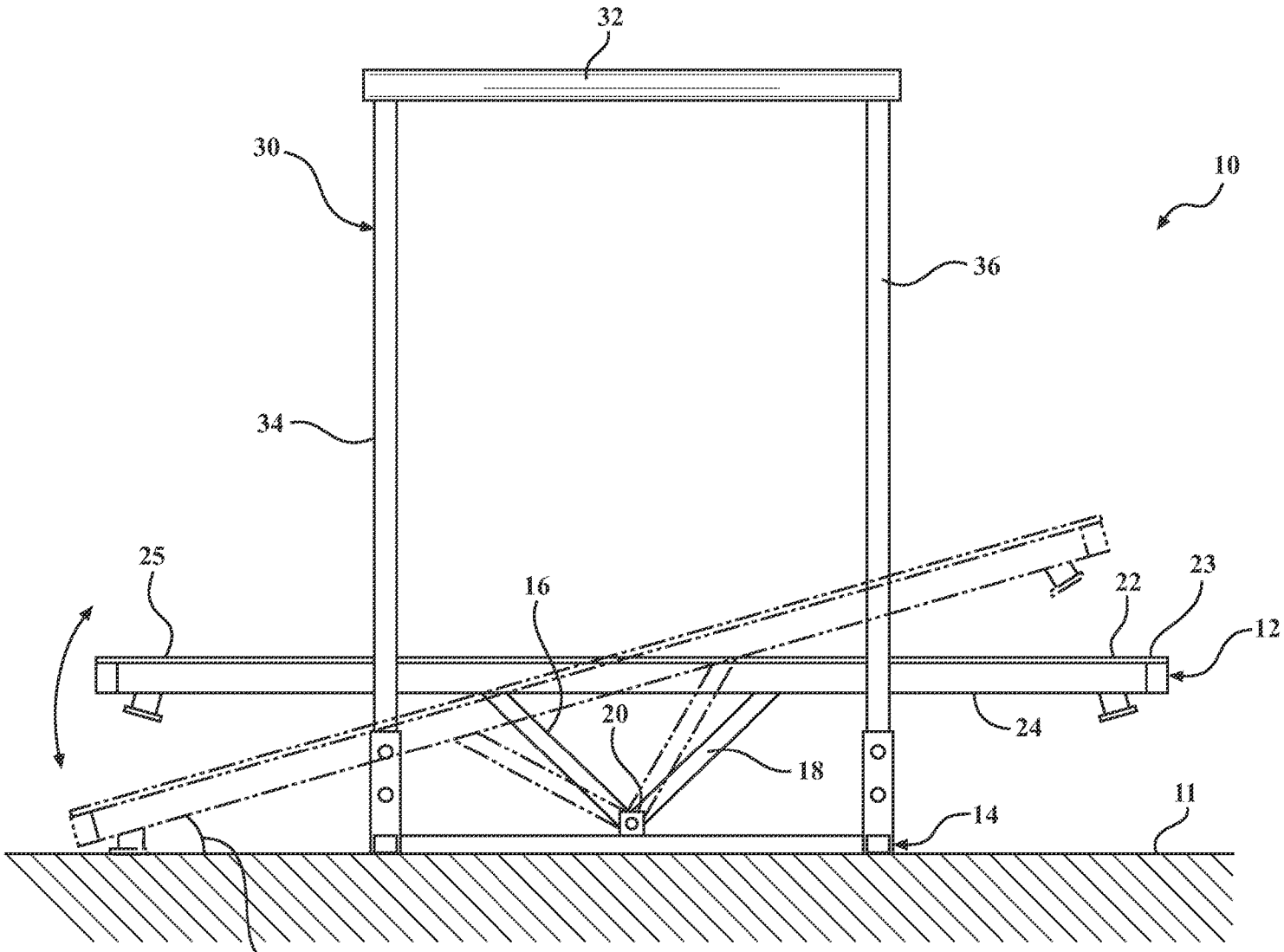
FIG. 1 illustrates a view of the exercise device.
Figure 2:
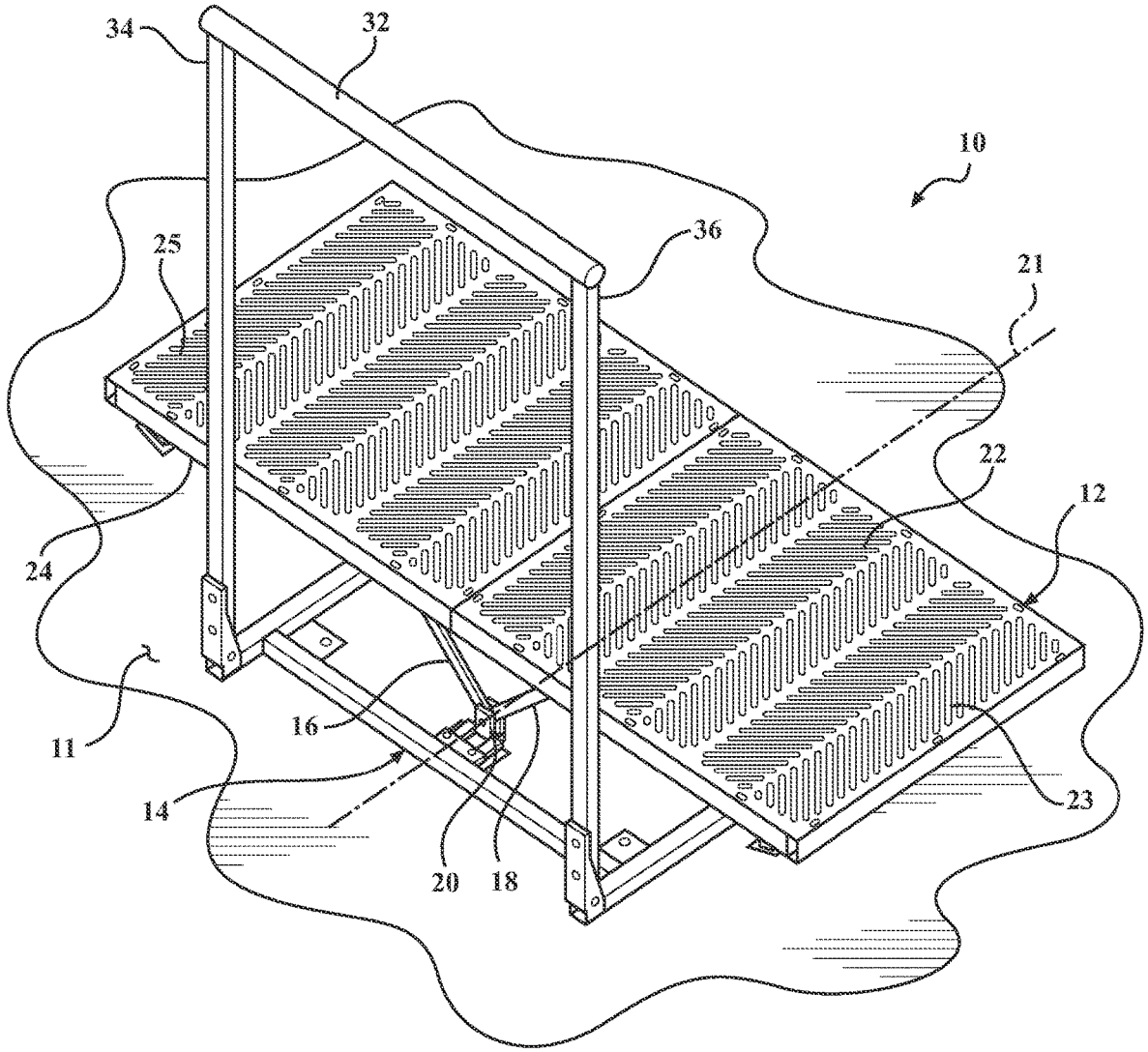
FIG. 2 illustrates a perspective view of the exercise device of FIG. 1.

Referring to FIGS. 1 and 2 illustrated is an exercise device 10. As its primary components, the exercise device 10 includes a platform 12 and a base 14 that may be supported by a support surface 11. The base 14 may be connected to the platform 12 using support arms, such as arms 16 and 18 that extend from a pivot point 20 of the base 14 towards the platform 12. The pivot point 20 essentially allows the arms 16 and 18, and therefore the platform 12, to rotate about an axis 21 defined by the pivot point 20. In this example, the axis 21 is substantially perpendicular to the length of the platform 12.

The platform 12 may be rectangular in shape. However, it should be understood that the platform 12 may take any one of a number of different shapes and does not necessarily need to be rectangular. The platform 12 may include a top side 22 and a bottom side 24. The top side 22 generally faces away from the base 14, while the bottom side 24 generally faces towards the base 14. The arms 16 and/or 18 may be connected to the bottom side 24 of the platform 12. In this example, only two arms—arms 16 and arm 18 are shown to connect the base 14 to the platform 12. However, it should be understood that any number of arms may be utilized to connect the base 14 to the platform 12, including a single arm or plurality of arms.

The top side 22 of the platform 12 may include a surface 87 that may be a slip-resistant surface that either utilizes a pattern and/or nonslip surface so that a user, when being supported by the platform 12, is less likely to slip. The platform 12 may have a first end 23 and a second end 25 that are generally located at opposing ends of the platform 12 and, as will be explained later, may have removable weights and/or stabilizer bars attached to them to provide additional utility to the exercise device 10.

The platform 12, being attached to the pivot point 20 of the base 14, generally has the ability to rotate about the axis 21 defined by the pivot point 20. As best shown in FIG. 1, the axis of rotation of the platform 12 may be restricted as the first end 23 and/or the second end 25 of the platform 12 come to contact with the support surface 11. Generally, the axis of rotation of the platform 12 may be between approximately −20 degrees and +20 degrees. As such, still referring to FIG. 1, when the platform 12 is rotated towards the left, as indicated in dashed lines, the angle 26 between the support surface 11 and a plane defined by the platform 12 may be approximately 20 degrees.

However, it should be understood that the axis of rotation of the platform 12 may vary. In this example, the axis of rotation is approximately between −20 degrees and +20 degrees but may be more or less. In one example, the axis of rotation may be approximately between −15 degrees and +15 degrees. In either example, when the axis of rotation is approximately zero degrees, the plane defined by the platform 12 should be substantially parallel to the plane defined by the support surface 11.

The exercise device may include a handlebar 30. In the example shown in FIGS. 1 and 2, the handlebar 30 includes members 34 and 36 and a crossbar 32. Generally, the members 34 and 36 extend upward away from the base 14 towards the platform 12. The crossbar 32 extends between the members 34 and 36 so as to provide a surface for allowing a user that is using the exercise device 10 to grip the crossbar 32. As such, the user, when utilizing the exercise device 10, will have the ability to move their body in different positions without falling. Generally, the length of the crossbar 32 of the handlebar 30 may be approximately 25% to 100% of the length of the top side 22 of the platform 12.

Figure 3:
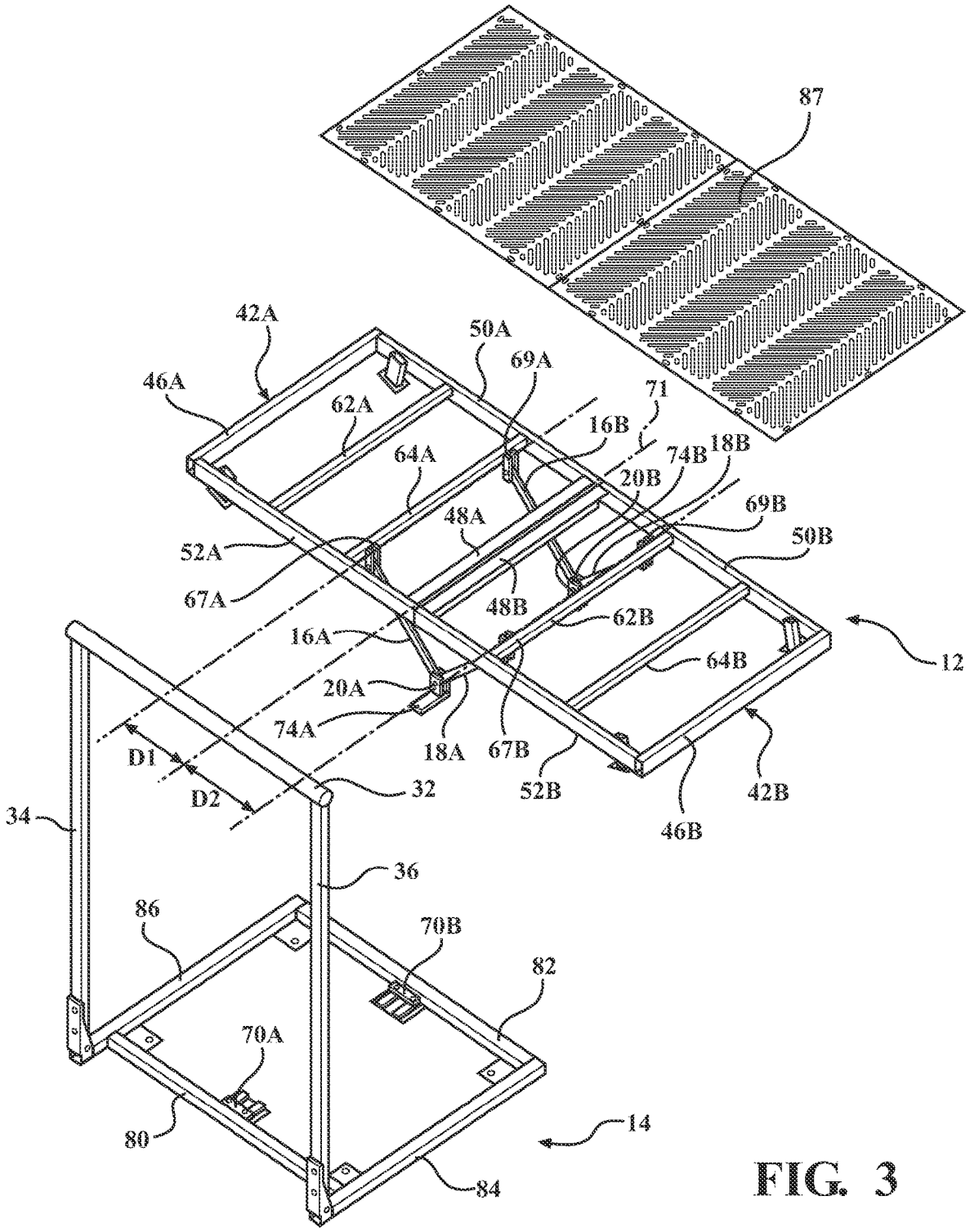
FIG. 3 illustrates a partially exploded view of the exercise device of FIG. 1

Referring to FIG. 3, a partially exploded view of the exercise device 10 is shown. Here, the platform 12 is shown to be made of a first frame 42A and a second frame 42B. The first frame 42A and the second frame 42B may be substantially similar to each other. Moreover, the first frame 42A includes perimeter members 46A, 48A, 50A, and 52A. The perimeter members 46A and 48A may generally oppose each other, while the perimeter members 50A and 52A may generally oppose each other. The perimeter members 46A, 48A, 50A, and 52A may form a substantially rectangular shape.

Similarly, the second frame 42B also includes perimeter members 46B, 48B, 50B, and 52B. The perimeter members 46B and 48B may substantially face each other, while the perimeter members 50B and 52B may substantially face each other, forming a rectangular shape.

The first frame 42A and the second frame 42B may be located adjacent to each other, such that the perimeter member 48A of the first frame 42A comes into contact or near contact with the perimeter member 48B of the second frame 42B. The first frame 42A and the second frame 42B may utilize one or more crossbars to increase the structural rigidity of the first frame 42A and/or the second frame 42B. For example, the first frame 42A may include crossbar 62A and 64A, while the second frame 42B may include crossbars 62B and 64B.

In this example, the arms 16A and 18A may be connected to the crossbars 64A and 64B at portions 67A and 67B, respectively. Arms 16B and 18B may also be connected to the crossbars 64A and 64B at portions 69A and 69B, respectively. Generally, the arms 16A and 18A, as well as the arms 16B and 18B may be substantially equal in length to one another. As such, a distance D1, defined as the distance between a centerline 71 that represents the center along the length of the platform 12 (where the first frame 42A and the second frame 42B meet) and the portion 67A or portion 69A is substantially similar to a distance D2, which is defined as the distance between a centerline 71 and the portion 67B or portion 69B.

The base 14 may include members 80, 82, 84, and 86 that arranged to form a rectangle. In this example, the members 80 and 82 substantially face each other, while the members 84 and 86 substantially face each other, forming a rectangle. The members 34 and 36 of the handlebar 30 may extend from the members 86 and 84, respectively.

The members 80 and 82 of the base 14 may include slots 70A and 70B for receiving pivot members 74A and 74B, respectively. The slots 70A and 70B essentially mate with pivot members 74A and 74B. The pivot members 74A and 74B may include pivot points, such as pivot points 20A and 20B, which allow the platform to rotate about the axis defined by the pivot points 20A and 20B.

As stated previously, the platform 12 may have a surface 87 attached to the top side 22 of the platform 12. In this example, the surface 87 includes both a pattern as well as a nonslip material to prevent the feet of a user that is utilizing the exercise device 10 from slipping unintentionally.

Figure 4:
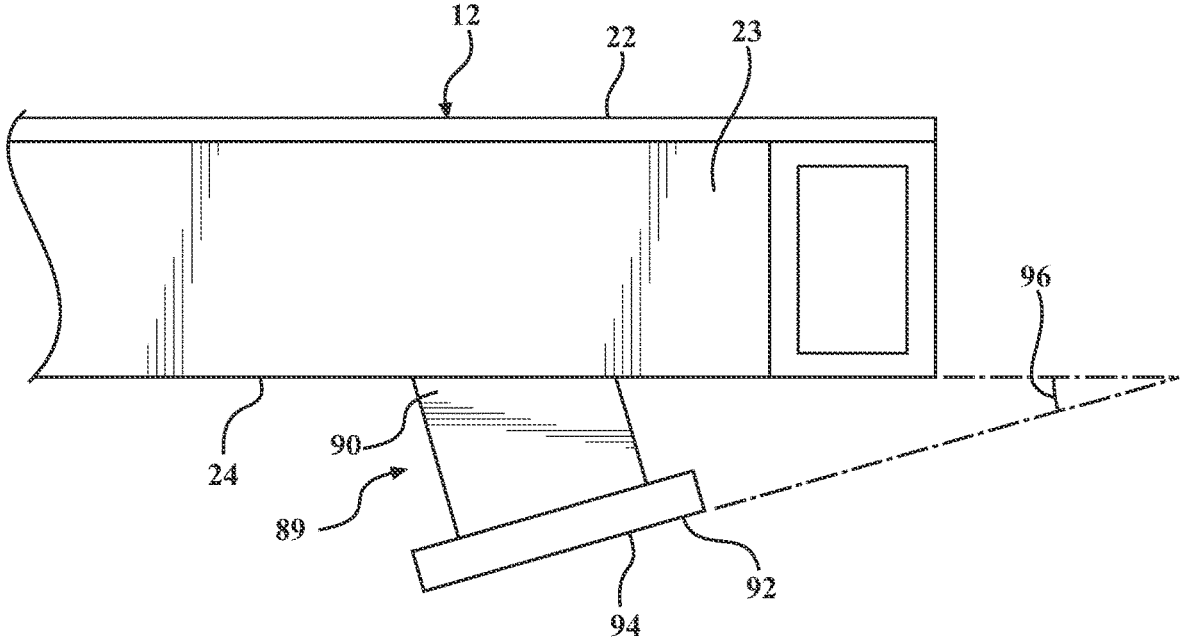
FIG. 4 illustrates a more detailed view of an end of a platform of the exercise device.

Referring to FIG. 4, illustrated is a more detailed view of the first end 23 of platform 12. It should be understood that the description could also apply to the second and 25 of the platform 12, as the first end 23 of the platform 12 is essentially a mirror image of the second and 25 of the platform 12. Here, the platform 12 includes a foot portion 89. The foot portion 89 includes an extending member 90 and a foot 92 having a bottom surface 94. The bottom surface 94 of the foot portion 89 is angled with respect to the length of the platform 12. The angle 96 of the foot portion 89 may be between 10 degrees and 20 degrees. Generally, the angle 96 of the bottom surface 94 of the foot portion 89 is such that when the first end 23 is driven towards the support surface 11 by the user when utilizing the exercise device 10, the bottom surface 94 should be substantially parallel and coming to contact with the support surface 11.

The bottom surface 94 may be made of a rigid material but could also be made of a flexible material so as to absorb some of the impact as the first end 23 is driven into the support surface 11. Additionally or alternatively, the extending member 90 may also be made of a rigid and/or flexible material to absorb some of the impact of the bottom surface 94 coming to contract with the support surface 11.

As stated previously, the first end 23 of the platform 12 may be essentially a mirror image of the second end 25 of the platform 12. As such, one or both of the first end 23 and/or second end 25 may have a foot portion 89 attached to them.

Figure 5:
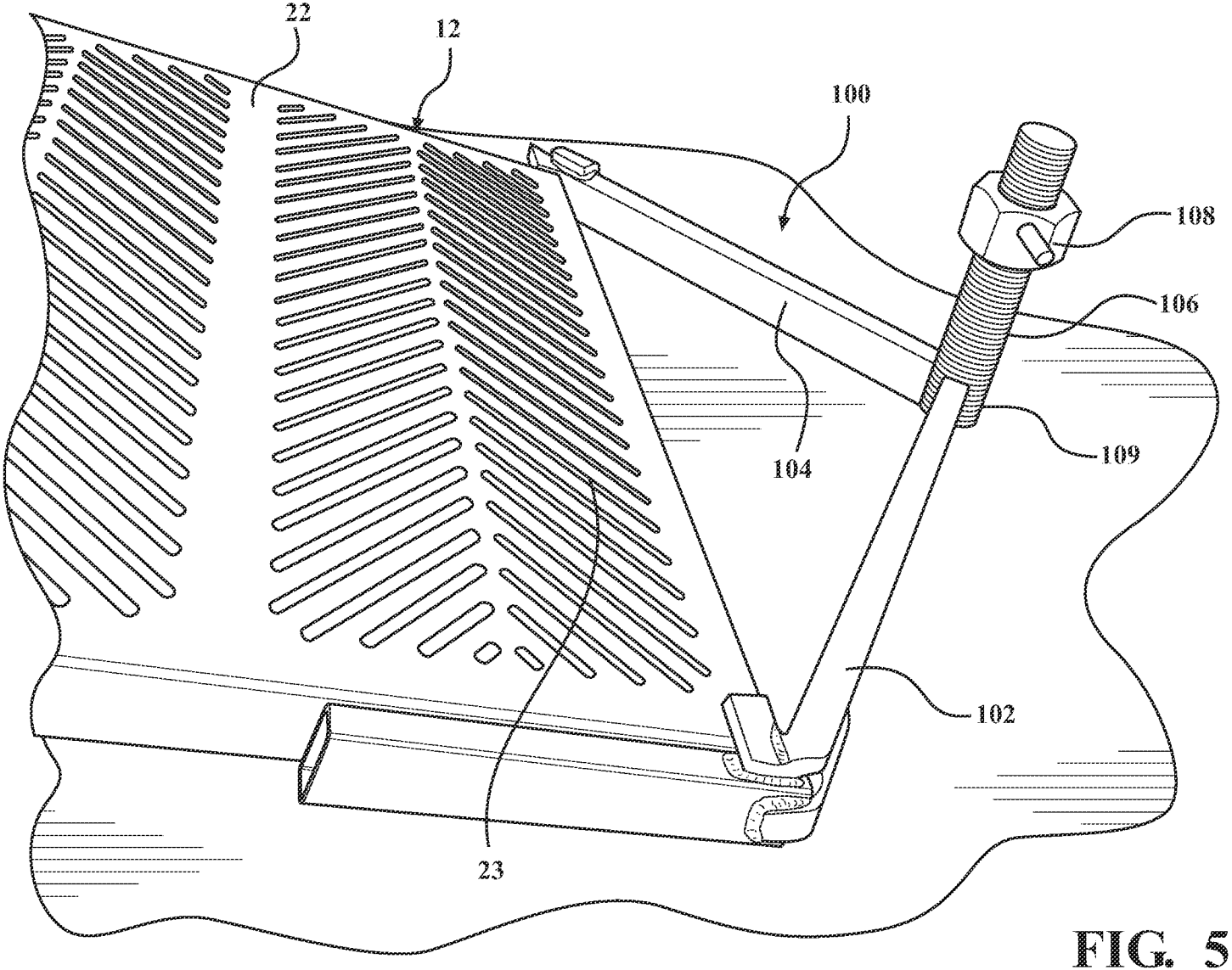
FIGS. 5 and 6 illustrate the exercise device being utilized with a removable weight member.
Figure 6:
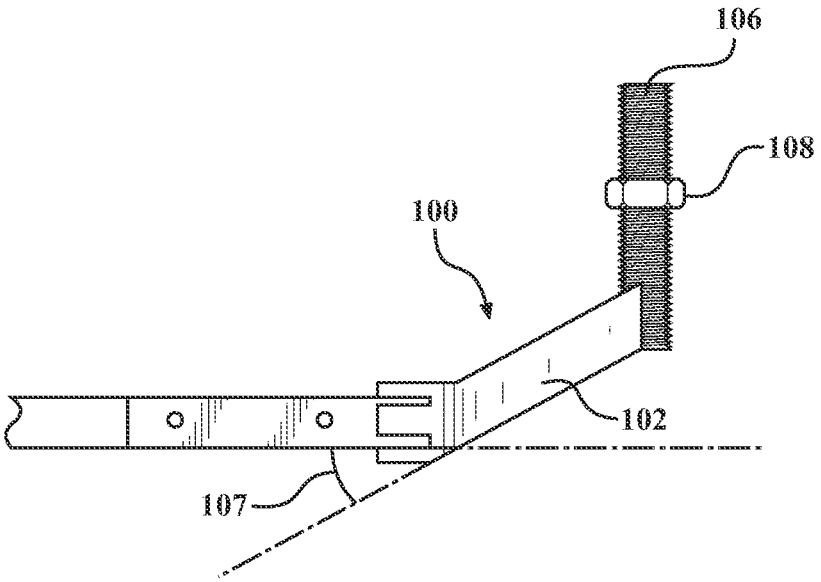

Referring to FIGS. 5 and 6, illustrated is the first end 23 of the platform 12 of the exercise device 10 that utilizes weights to provide additional resistance when the user utilizes the exercise device 10. In this example, the weight device 100 may include members 102 and 104 that extend at an angle 107 with respect to the platform 12. The angle 107 may be between 10 degrees and 20 degrees. Generally, the angle 107 is such that when the first end 23 is driven towards the support surface 11, the length of the members 102 and/or 104 are generally parallel to the support surface 11 and may rest upon the support surface 11.

The members 102 and 104 extend from the first end 23 and terminate at a common point 109. The weight device 100 may include a threaded member 106 that generally extends in an upward direction with respect to the members 102 and 104 at the common point 109. The threaded member 106 may include a thread for receiving a thread weight 108 that can be essentially screwed onto the threaded member 106. As such, the thread weight 108 may be one or more thread weights of different sizes and dimensions that can be added or removed from the threaded member 106 to add or decrease weight.

The weight device 100 may also be utilized at the second end 25 of the platform 12. Typically, when weight device is 100 are used at both the first end 23 and the second end 25 of the platform 12 additional weight associated with the weight devices 100 will be substantially similar.

Figure 7:
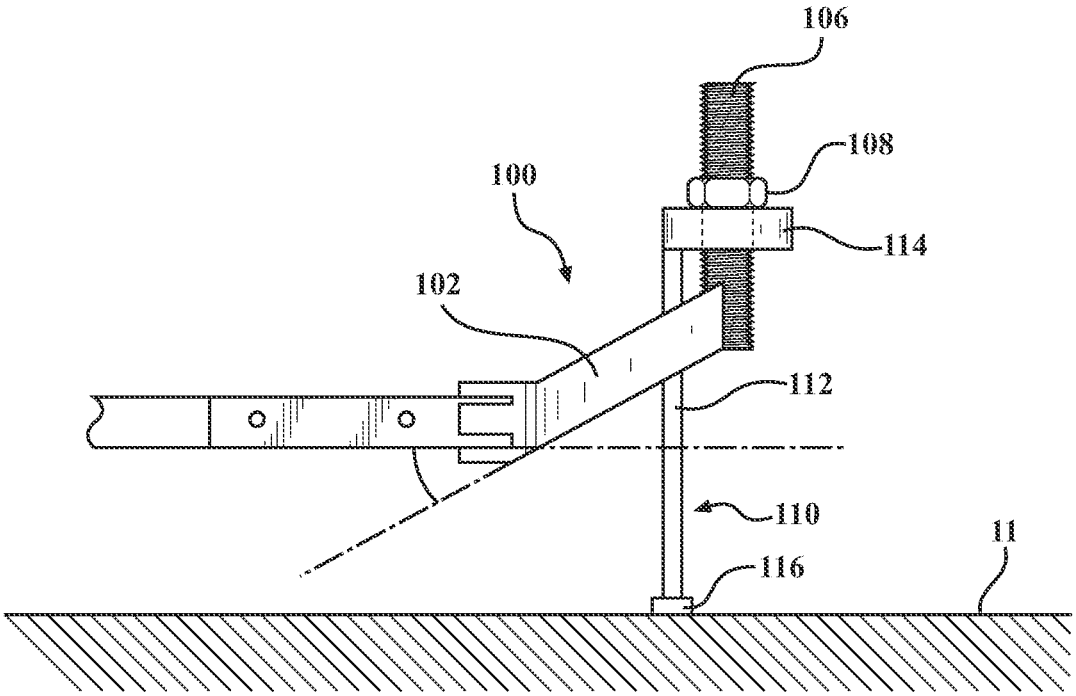
FIG. 7 illustrates the exercise device being utilized with a stabilizer bar.

FIG. 7 illustrates another example of the weight device 100. However, in this example, the weight device 100 also includes a stabilizer bar 110. The stabilizer bar 110 may include body portion 112 that includes a first end 114 and a second end 116. The first end 114 may be attached to the threaded member 106. The body portion 112 extends downwards towards the support surface 11. The second end 116 may include a foot member that may be utilized to come in contact with the support surface 11 when the first end 23 of the platform 12 is driven towards the support surface 11. By so doing, the stabilizer bar 110 essentially restricts the movement of the platform 12 with respect to the support surface 11, thus minimizing the angle of rotation of the platform 12 about the axis 21. In one example, the stabilizer bar 110 may minimize the angle of rotation to −5 degrees and +5 degrees. The length of the stabilizer bar 110 may be adjustable so as to increase/decrease the angle of rotation.

Figure 8A:
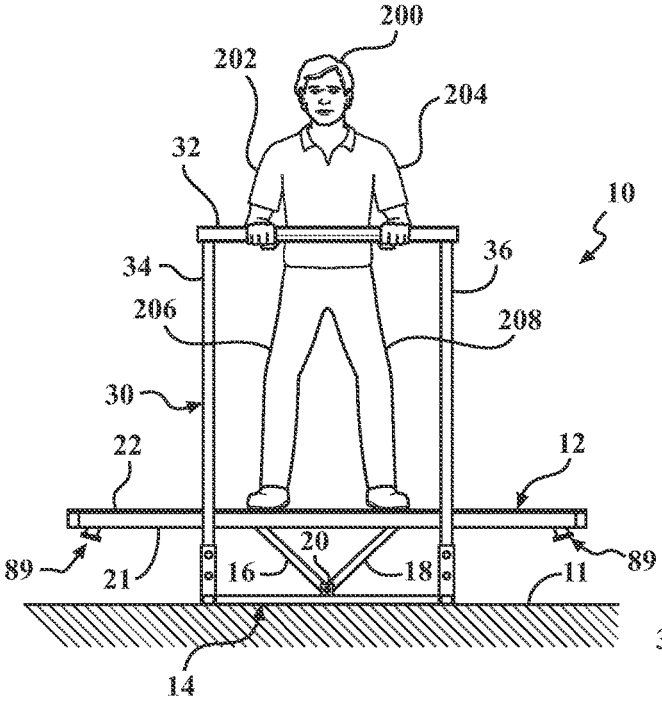
FIGS. 8A-8C illustrate a user utilizing the exercise device of FIG. 1.
Figure 8B:
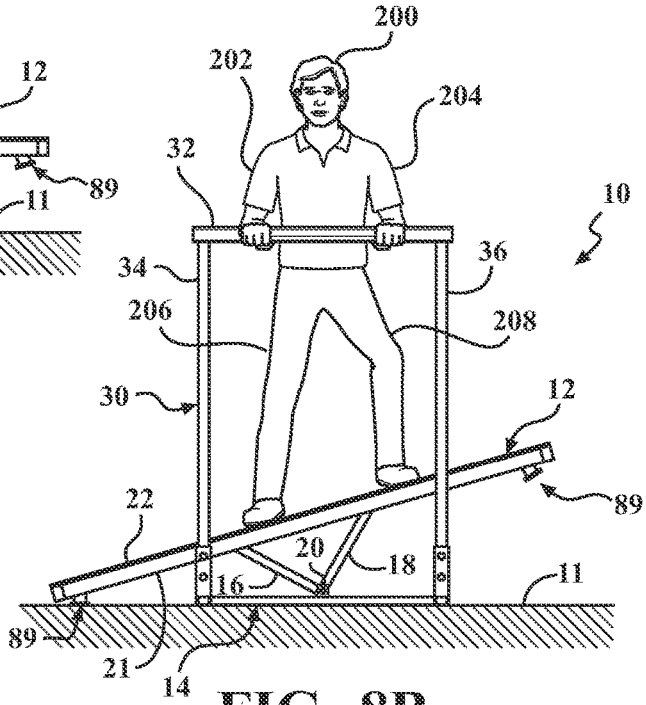
Figure 8C:
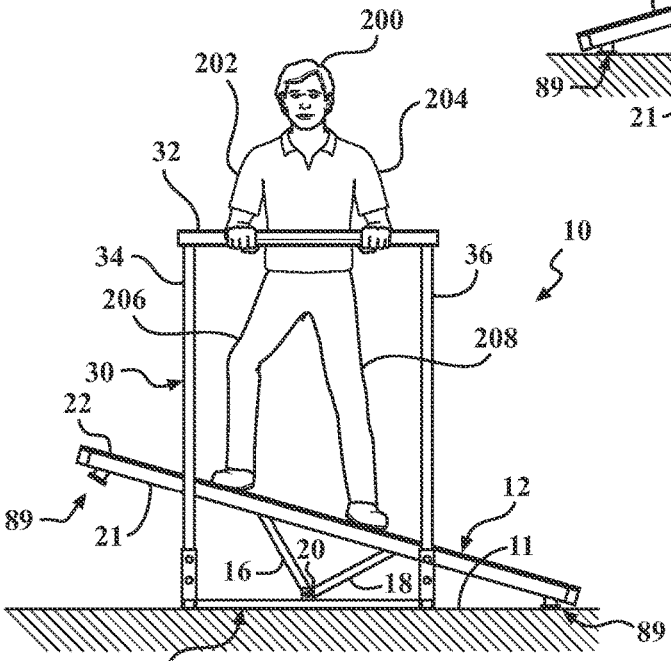

In order to better understand how a user interacts with the exercise device 10, reference is made to FIGS. 8A-8C. These figures illustrate a user 200 having arms 202 and 204 that are interacting with the handlebar 30 as well as legs 206 and 208 that are interacting with the platform 12. FIG. 8A illustrates the user 200 on the platform 12, wherein the platform 12 is substantially parallel to the support surface 11. As the user 200 moves the platform 12 back and forth using their legs, the user receives both strength training and cardiovascular training. As such, as best shown in FIG. 8B, the user 200 has moved the platform 12 to the left such that the second end 25 comes the contact with the support surface 11. Conversely, in FIG. 8C, the user 200 has moved the platform 12 to the right so that the first end 23 comes to contact with the support surface 11.

As such, as the user moves the platform 12 back-and-forth, the user 200 receives both strength training and cardiovascular training. Additionally, by utilizing additional weights, such as the weight device 100 described in FIGS. 5 and 6, additional resistance can be provided. Further, if the user wishes to restrict the movement of the platform 12, the stabilizer bar, such as a stabilizer bar 110 of FIG. 7, may be utilized.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC, or ABC).

Use of the terms "substantially," "approximately," "about," and the like, when performing comparisons regarding length, angle, or some other measurable dimension, should be interpreted as being approximately 10% of the equivalent value. For example, the phrase "length A is substantially equal to length B" should be interpreted such that the lengths of length A and length B are within 10% of each other.

Aspects herein can be embodied in other forms without departing from the spirit or essential attributes thereof. Accordingly, reference should be made to the following claims, rather than to the foregoing specification, as indicating the scope hereof.

What is claimed is:

1. An exercise device comprising:

a platform having a surface for supporting a user of the exercise device;

a rectangular base supported by a ground support surface, the rectangular base includes at least a first base member and a second base member, the first base member extending in a first direction, the second base member extending in a second direction, the first direction being perpendicular to the second direction, the first base member and the second base member being immediately adjacent to the ground support surface;

a pivot point directly coupled and immediately adjacent to the first base member, the pivot point defines an axis, wherein the axis is parallel to the second direction defined by the second base member;

at least one arm extending from the platform to the pivot point;

wherein the platform is configured to rotate about the axis defined by the pivot point; and a handlebar extending from the second base member towards the platform, the handlebar including a first handlebar member having a first end connected to the second base member and extending in a third direction from the second base member towards the platform and terminating in a second end and a second handlebar member connected to the second end of the first handlebar member that extends in a fourth direction;

wherein the third direction is substantially perpendicular to the fourth direction;

wherein the first direction is substantially parallel to the fourth direction;

a slot attached to the first base member of the base;

a pivot member having the pivot point, the pivot member being configured to mate with the slot for attaching the pivot point to the first base member of the base; and wherein the slot is located under the platform.

2. The exercise device of claim 1, wherein an axis of rotation of the platform about the pivot point is approximately between −20 degrees and +20 degrees.

3. The exercise device of claim 2, wherein the axis of rotation of the platform about the pivot point is approximately between −15 degrees and +15 degrees.

4. The exercise device of claim 2, wherein the surface of the platform defines a platform plane;

the ground support surface defines a ground support plane; and wherein the platform plane is substantially parallel to the ground support plane when the axis of rotation of the platform about the pivot point is approximately 0 degrees.

5. The exercise device of claim 1, wherein a length of the second handlebar member is approximately between 25% to 100% of the length of the surface of the platform.

6. The exercise device of claim 1, wherein the handlebar further comprises a third handlebar member connected to the second base member.

7. The exercise device of claim 1, further comprising a foot adjacent to an end of the platform, the foot having a bottom surface.

8. The exercise device of claim 7, wherein the bottom surface of the foot defines a foot plane and the surface of the platform defines a platform surface plane, the foot plane and the platform surface plane being at an angle with respect to each other, the angle being between approximately 10 degrees and 20 degrees.

9. The exercise device of claim 1, wherein the at least one arm includes a first arm and a second arm, the first arm being connected between a first portion of the platform and the pivot point and the second arm being connected to a second portion of the platform and the pivot point.

10. The exercise device of claim 9, wherein a length of the first arm and a length of the second arm are substantially equal.

11. The exercise device of claim 9, wherein a first distance, defined as a distance between the first portion of the platform to a center of a length of the platform, is substantially equal to a second distance, defined as a distance between the second portion of the platform to the center of the length of the platform.

12. The exercise device of claim 1, further comprising:

a first weight member removably attached to a first end of the platform; and a second weight member removably attached to a second end of the platform.

13. The exercise device of claim 12, wherein the first weight member and the second weight member extend diagonally at an angle from the platform.

14. The exercise device of claim 13, wherein the angle that the first weight member and the second weight member extend from the platform is approximately between 10 degrees and 20 degrees.

15. The exercise device of claim 12, wherein at least one of the first weight member and the second weight member includes a threaded member, wherein the threaded member is configured to receive removable weight devices that interact with the threaded member.

16. The exercise device of claim 1, further comprising:

a first stabilizing member removably attached to a first end of the platform; and a second stabilizing member removably attached to a second end of the platform, wherein the first stabilizing member and the second stabilizing member restrict an axis of rotation of the platform about the pivot point to approximately between −5 degrees and +5 degrees.

17. The exercise device of claim 1, wherein the second base member has a length that is greater than a width of the platform.

18. The exercise device of claim 17, wherein the first base member is longer than the second base member.

* * * * *